US005924155A

United States Patent [19]

Broz

[11] Patent Number: 5,924,155

[45] Date of Patent: Jul. 20, 1999

[54] ANTI-FLIP STRUT FOR A ROTARY BROOM LOADER ATTACHMENT

[75] Inventor: John J. Broz, Hinckley, Ill.

[73] Assignee: Farmers' Factory Co., Lee, Ill.

[21] Appl. No.: 08/895,419

[22] Filed: Jul. 16, 1997

[51] Int. Cl.[6] ..... E01H 1/05

[52] U.S. Cl. ..... 15/83

[58] Field of Search ..... 15/83, 84–86

*Primary Examiner*—Randall E. Chin
*Attorney, Agent, or Firm*—Leydig, Voit & Mayer, Ltd.

[57] ABSTRACT

An anti-flip strut for use with rotary broom attachments for skid steer loaders. The present invention provides a strut adapted to connect the rotary broom attachment to the loader arms of a skid steer and move between a fully extended and a fully retracted position. In the fully extended position, the rotary broom is prevented from forward rotation and thereby allows the bucket working in conjunction with the rotary broom to pivot forward and dump its load. In the fully retracted position when the loader arms are rotated above the skid steer loader, the strut prevents backward rotation of the rotary broom and thereby prevents damage to the skid steer and operator either through forcible contact with the skid steer or by causing the loader itself to tip over or otherwise loose its balance. Moreover, through the provision of a quick disconnect coupling system, the strut enables the rotary broom attachment to be quickly disconnected and attached to the loader arms of the skid steer.

20 Claims, 6 Drawing Sheets

ANTI-FLIP STRUT FOR A ROTARY BROOM LOADER ATTACHMENT

FIELD OF THE INVENTION

The present invention generally relates to vehicular loaders, and more particularly relates to attachments for skid steer loaders.

BACKGROUND OF THE INVENTION

Skid steer loaders are a commonly used vehicle for many industrial, agricultural, and landscaping operations. A skid steer loader is typically a relatively small four wheel vehicle which is steered by braking or driving two wheels on one side of the vehicle, while reversely driving the wheels on the other side of the vehicle. Two laterally spaced loader arms are mounted on the rear of the vehicle to swing upwardly and downwardly and, when the arms are down, their forward ends extend downwardly in front of the vehicle.

A number of attachments can then be coupled to the ends of the loader arm to make the skid steer applicable to many different types of applications. For example, a bucket is commonly provided to dig, dump, and transport materials such as dirt. Similarly, the skid steer can be adapted through various attachments to act as a forklift, back hoe, ground preparator, and the like.

In order for the skid steer to clean and sweep a given surface, an attachment known as a rotary broom can be attached to the front of a bucket also provided on the loader arms wherein the rotary broom is mounted for rotation within a housing pivotally attached to the bucket. When the loader arms are lowered, and the skid steer moves across a surface, the broom engages the dirt or other material and forces it into the bucket. The arms can then be raised and the bucket can be pivoted downward to allow the collected debris to be dumped at an appropriate receptacle.

With many prior art rotary brooms, chains are provided to attach the broom housing to the loader arms such that when the bucket pivots downward, the broom housing is maintained in position and therefore does not interfere with proper dumping of the debris from the bucket. While such a system effectively maintains the broom housing in the appropriate position and prevents forward rotation thereof, when the loader arms are raised and fully rolled back above the vehicle, the weight of the broom housing will tend to rotate backward, and the chains offer no resistance to such movement. The broom housing can therefore rotate backward and forcefully impact the skid steer and potentially injure the operator thereby, or can even overbalance the entire skid steer causing the skid steer to tip over and again risk injury not only to the skid steer itself but the operator as well.

It is important to understand that while skid steer loaders are identified herein as the predominate vehicle to which this invention is directed, it can be employed with equal efficacy to other types of vehicles having vertically or arcuately movable loader arms.

SUMMARY OF THE INVENTION

It is therefore a primary aim of the present invention to provide a safety device to prevent rearward rotation of a skid steer rotary broom, while at the same time enabling forward rotation of a bucket attached to the rotary broom.

It is an objective of the present invention to provide a strut adapted to connect a rotary broom to a skid steer and which is able to alternate between a compressed, shortened position, and a tensioned, lengthened position. In the tensioned, lengthened position, the strut prevents forward rotation of the rotary broom to enable the bucket to dump, and in the compressed, shortened position, the strut prevents backward rotation of the rotary broom to protect the skid steer and the operator.

It is another objective of the present invention to provide an anti-flip strut for use with a rotary broom attachment for a skid steer, which provides a quick disconnect fastener to enable the rotary broom attachment to be quickly disconnected and connected to the skid steer itself.

In accordance with these aims and objections, it is a feature of the present invention to provide an antiflip strut for a skid steer loader of the type having first and second loader arms pivotally attached to the loader and a rotary broom assembly pivotally attached to the loader arms. The rotary broom assembly includes a brush housing, having a brush mounted for rotation therein and pivotally attached to the bucket, with the brush being adapted to sweep debris into the bucket as the brush rotates and the loader moves over an area having debris disposed thereon. The strut itself comprises a first pivot point attached to the loader arm, a second pivot point attached to the rotatable brush housing, and means for adjusting the length of the strut assembly between a tensioned, fully lengthened position, and a compressed, fully shortened position. The strut is thereby in the tensioned, fully lengthened position when the bucket pivots away from the brush housing to dump a load of debris, and is in the compressed, fully shortened position when the loader arm is raised and fully rolled back above the loader to prevent the brush housing from rotating away from the bucket.

It is another feature of the present invention to provide the strut in the form of a first arm, second arm telescopingly received within the first pivot arm, and means for preventing movement of the arms beyond the fully retracted and fully extended positions.

It is another feature of the present invention to provide the aforementioned strut wherein the means for preventing movement beyond the extended and retracted positions includes an elongated slot in the first arm and a finger attached to the second arm protruding through the first arm slot, with the finger being adapted to engage first and second ends of the slot as the strut moves between the retracted and extended positions.

It is yet another feature of the present invention to provide the quick disconnect between the strut and the loader arms in the form of clevis pin with a hair pin cotter adapted to pass therethrough.

These and other aims, objectives and features of the present invention will become more apparent from the following detailed description when taken in conjunction with the accompanying drawings.

Figure 1:
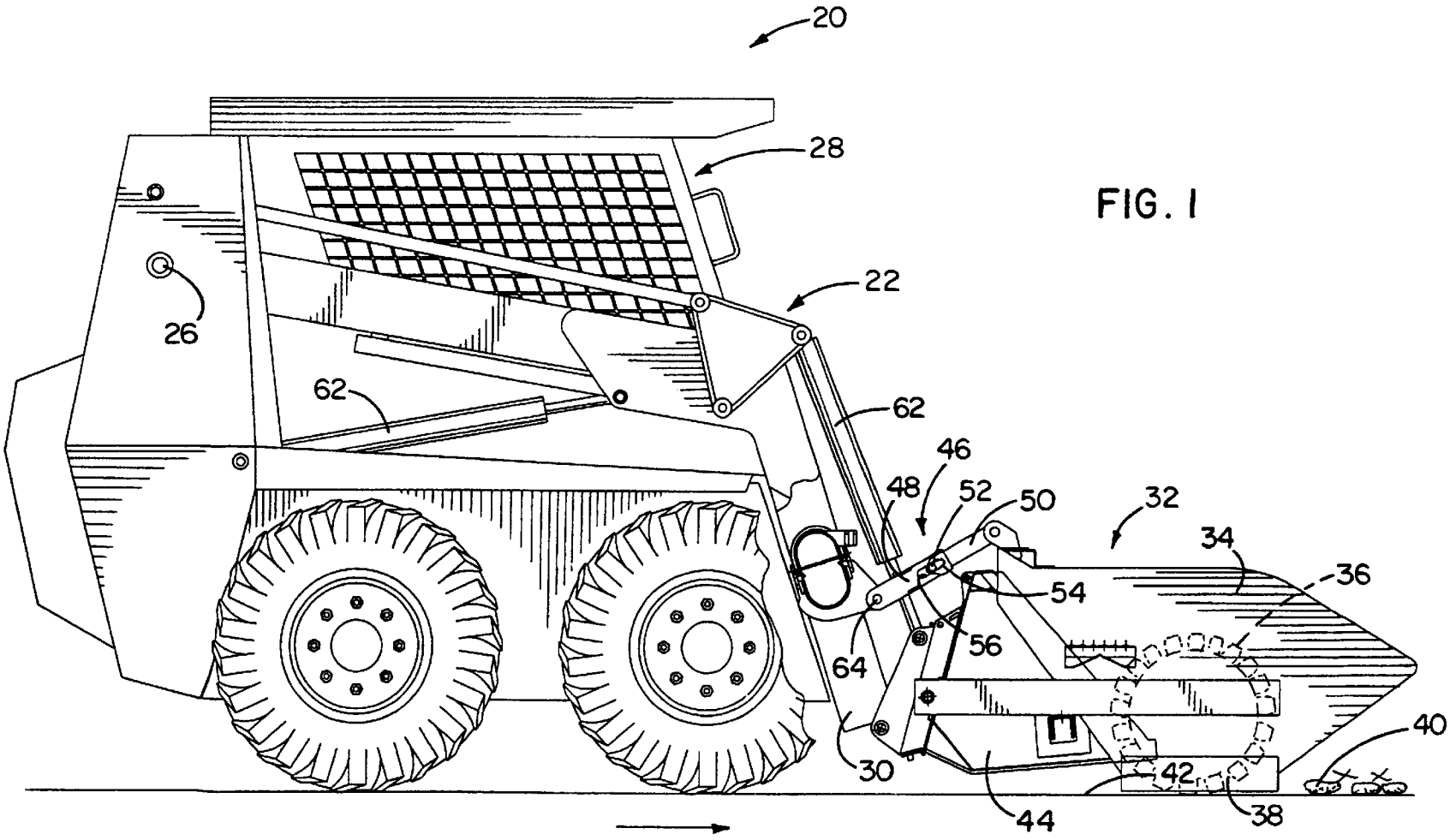
FIG. 1 is a side view of one embodiment of the present invention showing the rotary broom in the active position and the anti-flip strut in a neutral position.

While the present invention is susceptible of various modifications and alternative constructions, certain illustrative embodiments thereof have been shown in the drawings and will be described below in detail. It should be understood, however, that there is no intention to limit the present invention to the specific forms disclosed, but on the contrary, the intention is to cover all modifications, alternative constructions and equivalents falling within the spirit and scope of the present invention as defined by the appended claims.

DETAILED DESCRIPTION OF THE PREFERRED EMBODIMENT

Referring now to the drawings, and with specific reference to FIG. 1, it can be seen that the present invention is generally related to the field of small utility vehicles known as skid steers. Skid steer 20 is adapted for use in many industrial, agricultural and landscaping applications wherein easy maneuverability and powerful lifting and transporting capabilities are required. As shown therein, skid steer loader 20 is provided with a pair of laterally spaced loader arms 22 adapted for arcuate travel by way of hydraulic cylinders 62. As is conventional, loader arms 22 are pivotally attached to loader 20 at rearward pivots 26. Furthermore, loader 20 is provided with operator cabin 28, the importance of which will be described with further detail herein. It is to be understood that the present invention will most commonly be employed in conjunction with skid steer loaders, but could also be used in conjunction with other similar vehicles having hydraulically powered work arms.

Toward free end 30 of loader arms 22, a variety of attachments can be provided to tailor loader 20 to a range of different industrial, agricultural, landscaping or other applications. U.S. Pat. No. 5,171,124, assigned to the present assignee, discloses a few of the typical applications for such a skid steer, and is expressly incorporated by reference herein.

The attachment to which the present invention is most specifically directed, is shown in FIG. 1 as rotary broom assembly 32. As shown therein, rotary broom assembly 32 includes a broom housing 34 having a brush 36 mounted for rotation therein. Housing 34 is provided with an open bottom 38, such that brush 36 protrudes therefrom and can engage debris 40 provided on a surface over which loader 20 travels. By working in conjunction with bucket 44, debris 40 is forced into bucket 44 as loader 20 moves across surface 42.

Turning now to the crux of the present invention, FIG. 1 shows strut 46 connected to both broom housing 34 and loader arm 22. Strut 46 includes first arm 48 and second arm 50 telescopingly received within first arm 48. In the active position of rotary broom assembly 32 shown in FIG. 1, strut 46 is essentially in a neutral position wherein finger 52, which is attached to second arm 50. As broom housing 34 rides upon surface 42 in this active position, strut 46 is not needed to prevent forward rotation of broom housing 34.

Figure 2:
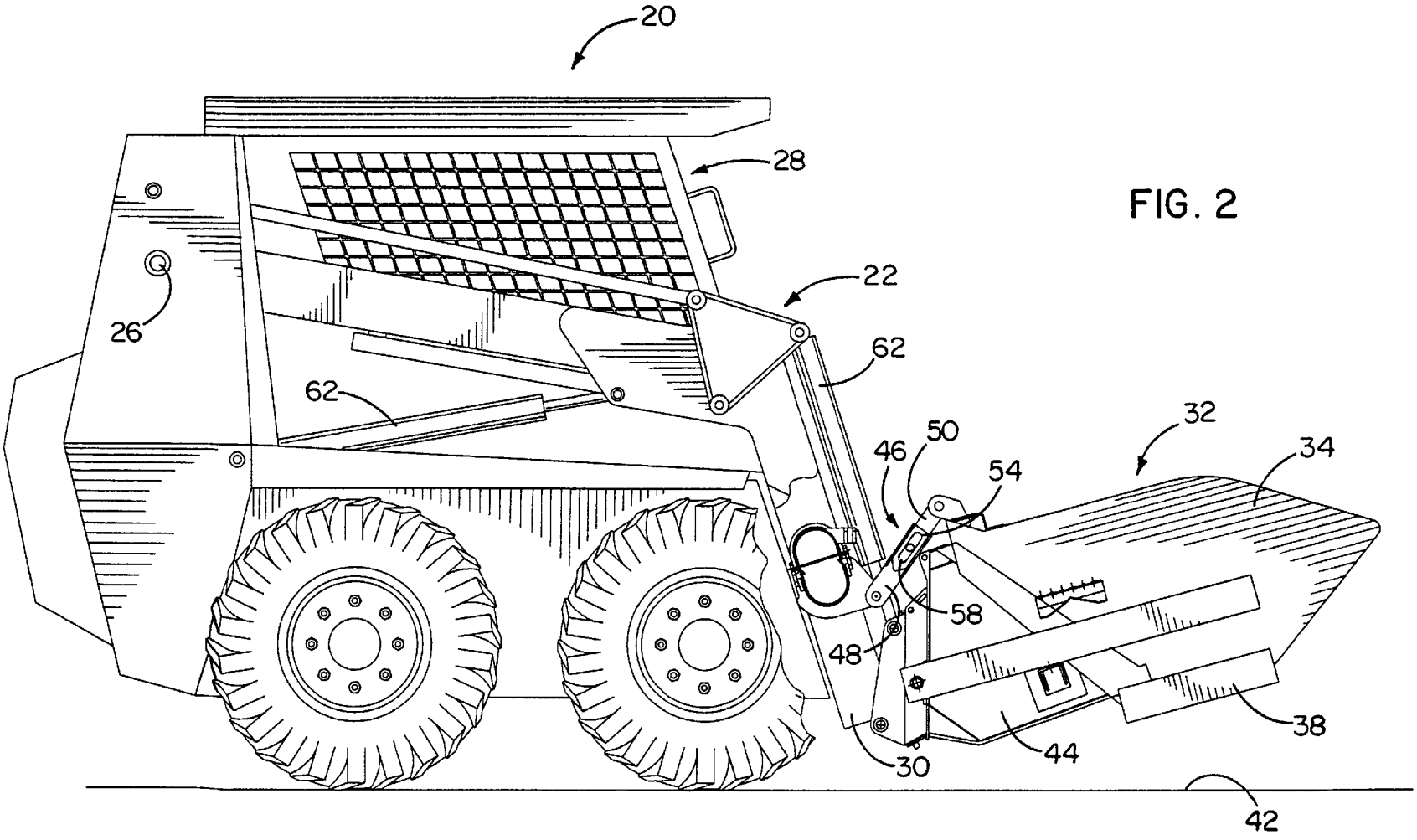
FIG. 2 is a side view of one embodiment of the present invention showing the rotary broom in the raised and transporting position.
Figure 3:
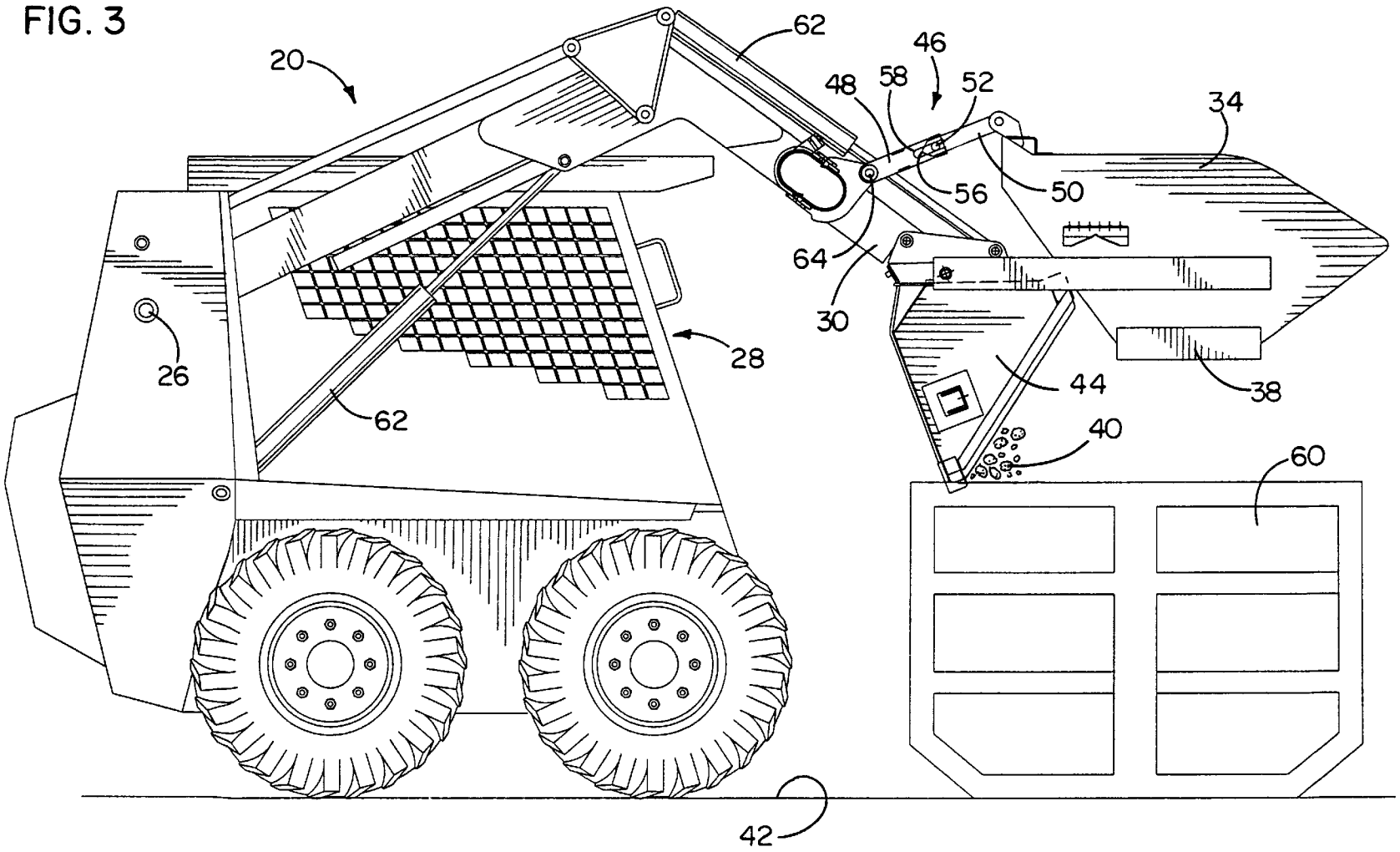
FIG. 3 is a side view of one embodiment of the present invention showing the rotary broom assembly in the dumping position, with the strut being in the fully extended position.

However, upon bucket 44 becoming full or for other reasons, bucket 44 can be pivoted upwardly along with broom housing 34 to the position shown in FIG. 2. In this transporting position, loader 20 can be driven to an appropriate position or receptacle to dump the contents of bucket 44. The effect of this on strut 46 is also depicted in FIG. 2, which shows finger 52 having moved slightly toward first end 58 of slot 56. Upon reaching the appropriate dumping receptacle, such as dumpster 60 shown in FIG. 3, bucket 44 can be pivoted forward by way of hydraulic cylinders 62 to dump debris 40. In this position, it can be seen that strut 46 is in its fully extended position, wherein finger 52 engages second end 54 of slot 56 and is therefore prevented from further forward rotation. This allows bucket 44 to rotate forward and separate from broom housing 34 to effectively dump its contents.

Figure 4:
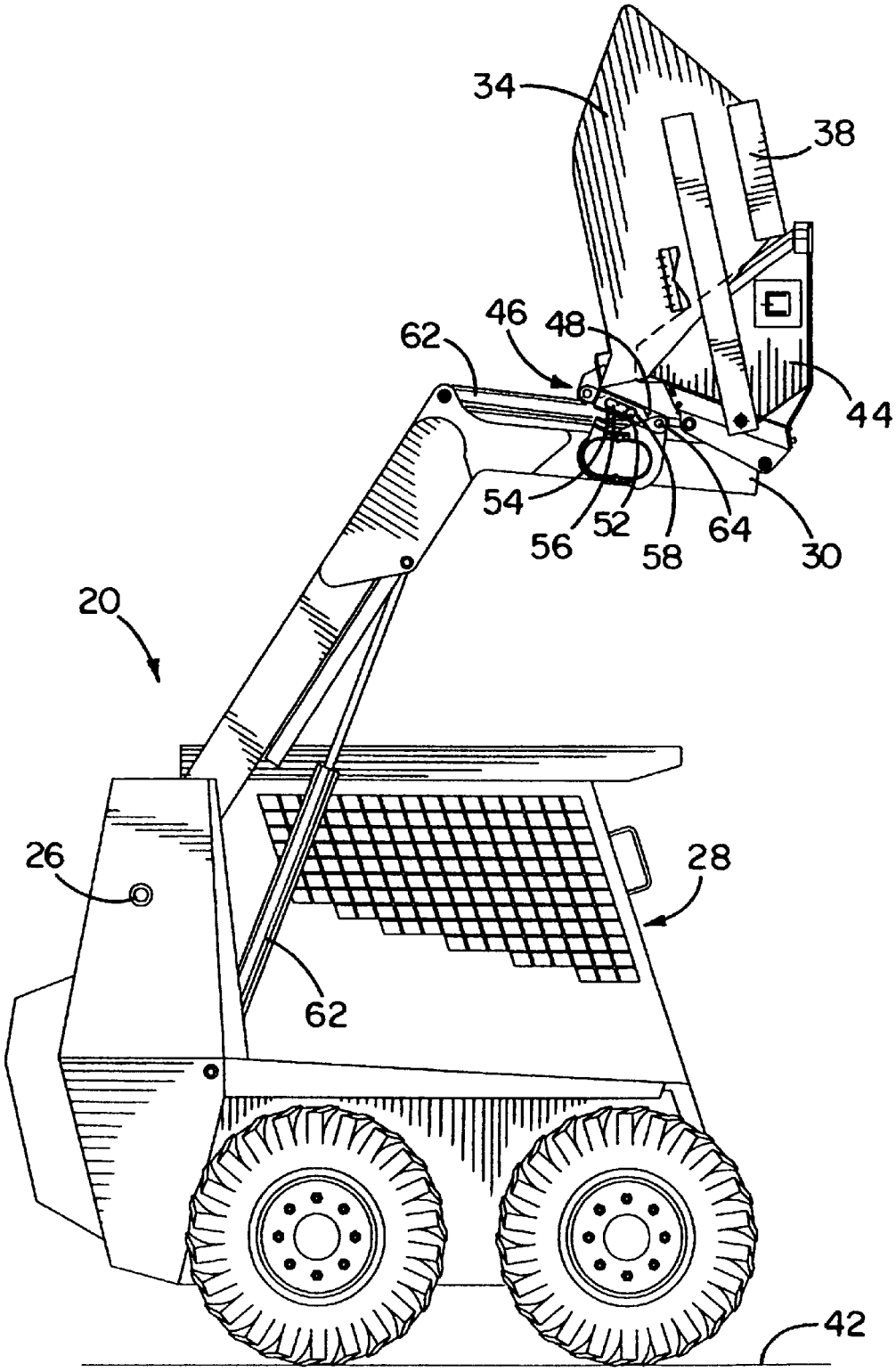
FIG. 4 is a side view of the one embodiment of the present invention showing the loader arms in a fully raised and rolled back position with the strut in the fully retracted and compressed position to prevent backward rotation of the rotary broom.
Figure 5:
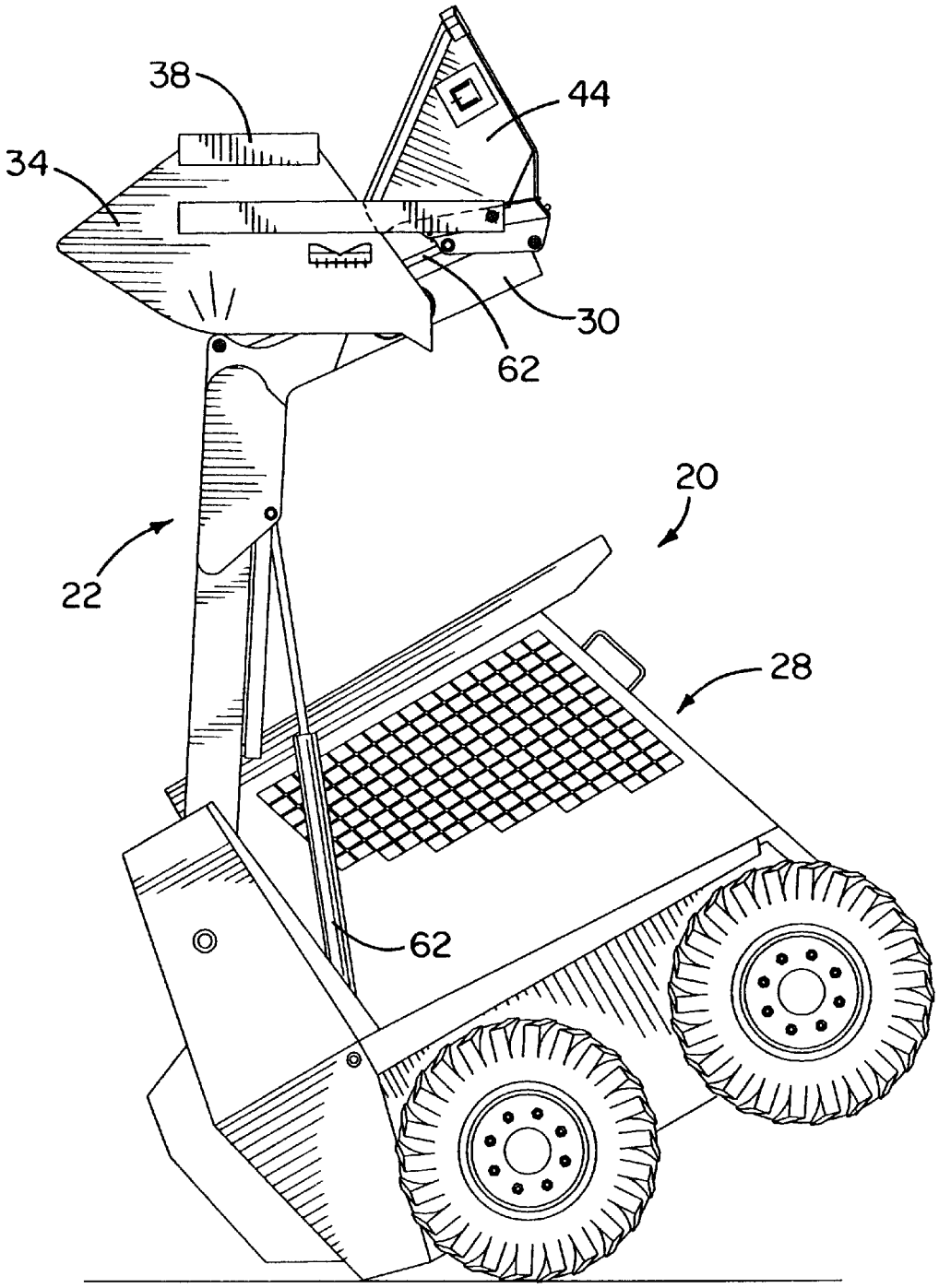
FIG. 5 (PRIOR ART)
FIG. 5 is a side view of a prior art rotary broom assembly showing the potentially hazardous over-rotation of the broom housing.

As described so far, the present invention functions in some aspects in the same way as do conventional prior art loaders wherein chains are provided to connect broom housing 34 to loader arms 22. The chains are brought into tension when in the dumping position and thereby prevent forward rotation of the broom housing to enable the bucket to dump its contents. However, starting with FIG. 4, the true inventiveness of the present invention is shown in detail. If it is necessary to dump the contents of bucket 44 to a relatively high level, or for some other reason loader arms 22 are raised to the point shown in FIG. 4, wherein they are disposed above loader 20, the weight and location of broom housing 34 will tend to cause it to rotate backward. This could of course cause serious damage to loader 20 or the operator located within cabin 28. Moreover, as is shown in FIG. 5, depending on the respective weights involved, the backward rotation of housing 34 can cause loader 22 itself to overbalance, or possibly tip over, and thus cause serious damage not only to the loader 20 but to the operator as well. With prior art systems employing conventional chains, the chains offer no resistance to such backward travel by broom housing 34.

However, with the present invention, and now referring again to FIG. 4, it can be seen that strut 46 is placed in its fully retracted or compressed position when loader arms 22 are raised above loader 20 to thereby prevent backward rotation by broom housing 34. Such backward rotation is prevented in that finger 52 slides along slot 56 until it engages first end 58 and is then prevented from further movement. Broom housing 34 is therefore maintained in a safe position without risk of injury to the operator or the loader itself.

Figure 6:
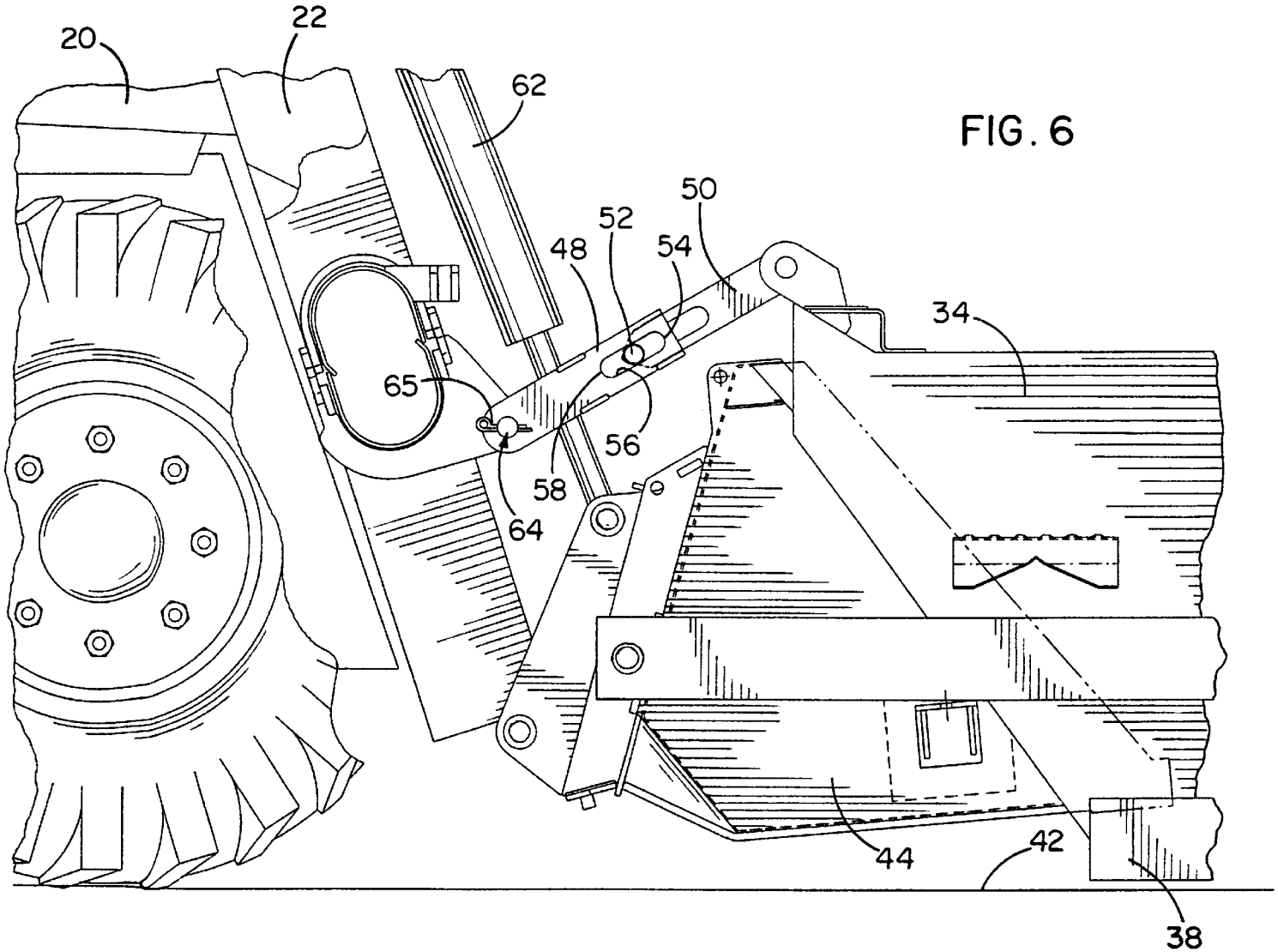
FIG. 6 is an enlarged side view of the anti-flip strut and portions of the rotary broom assembly and skid steer.

Another inventive feature of the present invention is provided in the manner in which first arm 48 is attached to loader arm 22. With specific reference now to FIG. 6, it can be seen that first arm 48 is attached to loader arm 22 by a quick disconnect pin. In the preferred embodiment, the quick disconnect pin is provided in the form of a clevis pin 64 having a hair pin cotter 65 therethrough. Clevis pin 64 is preferably 1" in diameter while hair pin cotter 65 is 3/16" in diameter, but other dimensions are certainly possible. Therefore, when it is desired to disconnect strut 46 from loader arm 22, for example when it is desired to detach rotary broom assembly 32 from loader arms 22 and then re-attach a different type of implement, hair pin cotter 65 can simply be removed from clevis pin 64 and clevis pin 64 can then be removed to separate strut 46 from loader arm 22. Similarly, in alternative embodiments a similar quick disconnect pin can be provided at the pivot point between second arm 50 and broom housing 34. However, in the normal course of operation, strut 46 will remain attached to broom housing 34 as it is not necessary with other types of implements.

From the foregoing, it can be appreciated by one of ordinary skill in the art that the present invention provides a new and improved anti-flip strut for use with a rotary broom assembly attachment for a skid steer loader. This is an opposition to prior art devices which only prevent forward rotation of the broom housing by way of conventional chains, and therefore provide no resistance to prevent backward rotation of the rotary broom. Therefore, not only does the present invention prevent forward rotation of the broom housing when it is desired to dump the contents of the bucket, but the present invention also provides a substantial safety feature in that when the loader arms are raised fully above the loader, the strut is placed into compression to thereby prevent the broom housing from over-rotating and damaging the loader, the operator, or both. Moreover, through the use of a quick disconnect system, the strut of the present invention can be quickly disconnected from the loader arms of the loader to thereby enable the broom assembly to be quickly disconnected, and thereby allow additional implements to be re-attached to the loader.

What is claimed is:

1. An anti-flip strut for a skid steer loader having first and second loader arms pivotally attached to the loader and a rotary broom assembly pivotally attached to the loader arms, the rotary broom assembly including a brush housing having a brush mounted for rotation therein and being pivotally attached to a bucket, the brush adapted to sweep debris into the bucket as the brush rotates and the loader moves over an area having debris, the strut comprising:

a first pivot point attached to the loader arm;

a second pivot point attached to the brush housing; and means for adjusting the length of the strut between a tensioned, fully lengthened position, and a compressed, fully shortened position, the strut being in the tensioned, fully lengthened position when the bucket pivots away from the brush housing to dump a load of debris, the strut being in the compressed, fully shortened position when the loader arm is raised above the loader to prevent the brush housing from rotating away from the bucket.

2. The strut of claim 1 including a first arm, second arm telescopingly received within the first arm, and means for preventing movement of the arms beyond the fully lengthened and fully shortened positions of the strut.

3. The strut of claim 2 wherein the means for preventing movement includes an elongated slot in the first arm and a finger attached to the second arm and protruding through the first arm slot, the finger adapted to engage first and second ends of the slot as the strut moves between the shortened and lengthened positions.

4. The strut of claim 1 wherein the first and second pivot points include fasteners adapted to be quickly fastened and removed to allow the rotary broom assembly to be quickly detached from the loader.

5. The strut of claim 4 wherein each fastener includes a clevis pin with a hair pin cotter adapted to pass therethrough.

6. The anti-flip strut of claim 1 wherein the loader, bucket, and brush are hydraulically powered.

7. A skid steer loader with rotary broom attachment, comprising:

a self propelled vehicle;

first and second loader arms pivotally attached to the vehicle and adapted to rotate between a first position in front of the vehicle, and a second position above the vehicle;

a bucket pivotally attached to the loader arms and adapted to rotate between a loading position and a dump position;

a broom housing pivotally attached to the bucket, the broom housing forming a chamber in communication with the bucket when the bucket is in the loading position;

a rotary brush mounted for rotation within the broom housing, the brush protruding through an open bottom of the broom housing and thereby being adapted to brush debris into the bucket as the vehicle traverses a surface with the loader arms in front of the vehicle and the bucket in the loading position; and an anti-flip strut pivotally attached to the loader arms and the broom housing, the strut adapted to lengthen to an extended position when the bucket is in the dump position to thereby maintain the position of the broom housing and enabling the bucket to pivot away from the broom housing, the strut adapted to retract to a compressed position when the loader arms are raised and fully rolled back above the vehicle and the bucket is in the loading position to thereby prevent the broom housing from pivoting away from the bucket and damaging the vehicle or an operator thereof.

8. The loader of claim 7 wherein the strut includes a first arm, a second arm telescopingly received within the first arm, and means for preventing movement of the arms beyond the fully extended and compressed positions.

9. The loader of claim 7 wherein the means for preventing movement includes an elongated slot in the first arm and a finger attached to the second arm and protruding through the first arm slot, the finger adapted to engage first and second ends of the slot as the strut moves between the compressed and extended positions.

10. The loader of claim 7 wherein the first and second pivot points include fasteners adapted to be quickly fastened and removed to allow the broom housing to be quickly detached from the loader.

11. The loader of claim 10 wherein each fastener includes a clevis pin with a hair pin cotter adapted to pass therethrough.

12. The loader of claim 7 when the loader arms are pivotally attached to a rear of the vehicle and are hydraulically powered.

13. The loader of claim 7 wherein the bucket and brush are hydraulically powered.

14. A rotary broom attachment for a skid steer loader comprising:

a bucket pivotally attached to first and second loader arms of the loader;

a broom housing pivotally attached to the bucket and having a brush mounted for rotation therein, the brush protruding through an open bottom of the housing and adapted to brush debris into the bucket as the loader moves across a surface with the rotary broom attachment in a lowered position; and a strut pivotally attached to the loader arms and the broom housing, the strut preventing forward rotation of the broom housing when the bucket is pivoted to a dumping position, the strut preventing rearward rotation of the broom housing when the loader arms are moved above the loader.

15. The rotary broom attachment of claim 14 wherein the strut includes a first arm, a second arm telescopingly received within the first arm, and means for preventing movement of the arms beyond predetermined positions.

16. The strut of claim 15 wherein the means for preventing movement includes an elongated slot in the first arm and a finger attached to the second arm and protruding through the first arm slot, the finger adapted to engage first and second ends of the slot as the strut moves between retracted and extended positions.

17. The rotary broom attachment of claim 14 wherein the strut is attached to the loader arms and the broom housing using a quick disconnect fastener to allow the rotary broom attachment to be quickly detached from the loader.

18. The rotary broom attachment of claim 17 wherein each quick disconnect fastener includes a clevis pin with a hair pin cotter adapted to pass therethrough.

19. The broom attachment of claim 14 wherein the loader arms are pivotally attached to a rear of the loader and are hydraulically powered.

20. The rotary broom attachment of claim 14 wherein the bucket and brush are hydraulically powered.

* * * * *